United States Patent [19]

Goldman et al.

[11] Patent Number: 4,856,117

[45] **Date of Patent: * Aug. 15, 1989**

[54] COLLAPSIBLE CAP

[75] Inventors: Stephen Goldman; John Richardson, both of Little Rock, Ark.

[73] Assignee: Bancroft Cap Company, Framingham, Mass.

[ * ] Notice: The portion of the term of this patent subsequent to Dec. 13, 2005 has been disclaimed.

[21] Appl. No.: 224,461

[22] Filed: Jul. 26, 1988

Related U.S. Application Data

[63] Continuation-in-part of Ser. No. 96,006, Sep. 14, 1987, Pat. No. 4,790,033.

[51] Int. Cl.[4] ..... A42B 1/00; A42B 1/20

[52] U.S. Cl. ..... 2/195; 2/180

[58] Field of Search ..... 2/195, 180, 196, 209.1, 2/171, 175, 199

[56] References Cited

U.S. PATENT DOCUMENTS

| | | | |
|---|---|---|---|
| 2,450,148 | 9/1948 | Libshutz et al. | 2/195 |
| 3,164,842 | 7/1978 | Weinstein | 2/195 |
| 3,482,266 | 12/1969 | Wagner | 2/180 |
| 3,816,852 | 6/1974 | Weinstein | 2/195 |
| 4,790,033 | 12/1988 | Goldman et al. | 2/195 |

*Primary Examiner*—Peter Nerbun

*Attorney, Agent, or Firm*—Ronald Reichman

[57] ABSTRACT

This invention is an improved collapsible cap that may be easily opened and closed so that when the cap is in a closed position the cap will be of relatively uniform height allowing the cap to be easily packed and stored. The apparatus of this invention accomplishes the foregoing by encapsulating the opening and closing mechanism of the cap, i.e., a hinge having a pivot pin in a plastic material and attaching one portion of the plastic material to the cap frame and another portion of the plastic material to a folded over encircling fabric tape containing a circular wire grommet.

8 Claims, 1 Drawing Sheet

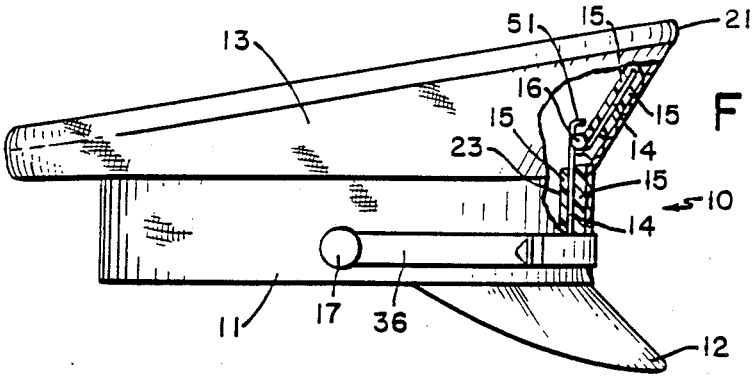
FIG. 1
FIG. 2
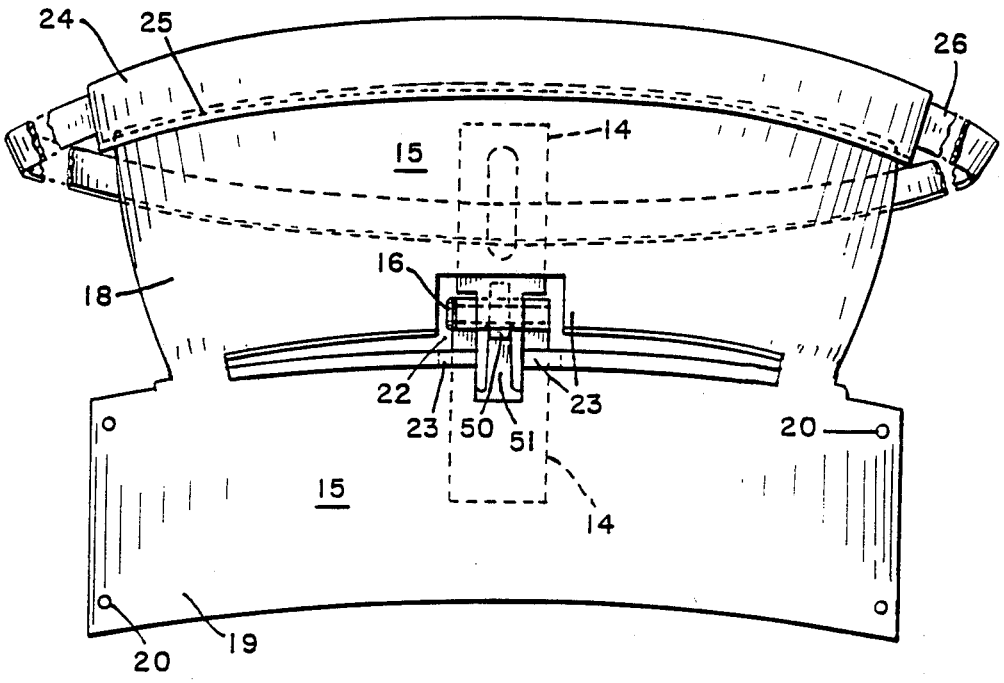
FIG. 3
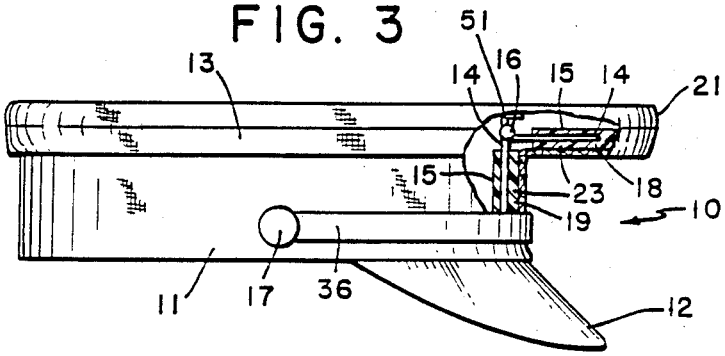

COLLAPSIBLE CAP

This is a continuation-in-part of application Ser. No. 096,006, filed Sept. 14, 1987, now U.S. Pat. No. 4,790,033.

FIELD OF THE INVENTION

This invention relates to articles of clothing, and more particularly, to collapsible caps.

DESCRIPTION OF THE PRIOR ART

From the dawn of civilization to the present time, people have been wearing clothing and packing extra clothing when they traveled from one location to another. It was particularly difficult to pack, ship and store certain types of military caps. The reason for the foregoing was that the caps were not of uniform height. Typically, the caps has a relatively stiff band or frame, a visor and a flaring front crown or peak which was normally held in a raised position by a circular wire grommet which was inclined with respect to the top of the band. Thus, the height of the cap in front between the bottom edge of the visor and the top of the cap is materially greater than the height at the rear portion of the cap, which is substantially no greater than the height of the band or frame.

One of the solutions utilized by the prior art to solve the above storage and shipping problem is disclosed in U.S. Pat. No. 3,816,852 entitled "Uniform Caps". The device disclosed in the abovementioned patent employed: a stiff plastic stay that was sewn at its top edge to an encircling fabric tape which in turn was sewn within a folded over edge at the cap seam; a pivot plate of a hinge having a base plate and pivot pin, said pivot plate being rigidly attached to said stay and a base plate which was riveted to a mounting plate, said mounting plate being riveted to the cap frame, whereby when said hinge was closed, the cap would be folded into a substantially flattened unit. While the above device is effective, many time-consuming steps are required to manufacture the device. Thus, caps having collapsible features were more expensive than caps not having collapsible features.

A second disadvantage of prior art collapsible caps are that the caps are difficult to open and close.

A third disadvantage of prior art collapsible caps are that the opening and closing of the caps stresses the caps' fabric.

A fourth disadvantage of prior art collapsible caps is that the life of the caps is decreased by the fabric being distorted when the cap is in a closed position.

SUMMARY OF THE INVENTION

This invention overcomes the disadvantages of the prior art by providing a collapsible cap that has an improved opening and closing mechanism that allows the cap to be easily opened and closed without stressing the cap and distorting the fabric of the cap. The apparatus of this invention accomplishes the foregoing by encapsulating the opening and closing mechanism of the cap, i.e., hinge and pivot pin in a plastic material and attaching one portion of the plastic material to the cap frame and another portion of the plastic material to a fabric tape that contains a wirre grommet which is placed under the cap cover. Thus, the apparatus of this invention requires less manufacturing steps than similar prior art devices.

The bonding of the hinge in a plastic material makes the hinge, pivot pin and plastic material a structure having some rigidity so that one portion of the same piece of plastic material will be connected to the cap frame and another portion of the same plastic material will be connected to a fabric tape that contains a wire grommet which is placed under the cap cover. Thus, most of the hinge will be contained within the plastic material. Hence, the cap will be easier to open and close, and have a longer life.

It is an object of this invention to provide a new and improved collapsible cap that is easy to open and close.

It is another object of this invention to provide a new and improved collapsible cap that is not distorted when it is in a closed position.

It is a further object of this invention to provide a new and improved collapsible cap that is easy to pack and store.

Further objects and advantages of this invention will become more apparent as the following description proceeds, which invention should be considered together with the accompanying drawings.

BRIEF DESCRIPTION OF THE DRAWINGS

FIG. 1 is a side view of a cap showing the connection of the opening and closing mechanism described in FIG. 2 when the cap is in an open position.

FIG. 2 is a front view of the opening and closing mechanism of cap 10.

FIG. 3 is a side view of a cap showing the connection of the opening and closing mechanism described in FIG. 2 when the cap is in a closed position.

DESCRIPTION OF A PREFERRED EMBODIMENT

Referring now to the drawings in detail, and more particularly to FIG. 1, the reference character 10 designates a cap that has a band or frame 11 sized to fit the head of the wearer, a forwardly and downwardly extending visor 12, a non-self-supporting cap cover 13, a peak 21, a hinge 14 and a plastic material 15 that encapsulates hinge 14. Hinge 14 includes a pivot pin 16 and a leaf spring 51. A decorative leather band 36 extends over the front half of frame 11 and is attached thereto by mounting buttons 17.

The construction of cap 10 without hinge 14 and plastic encapsulating material 15 is old and well known in the art.

FIG. 2 illustrates hinge 14 with a portion of hinge 14 removed to form a leaf spring 51 and a pivot pin 16. Hinge 14 includes a cam 50. Cam 50 and leaf spring 51 are used to supply resistance to the opening and closing of hinge 14. Hinge 14 is partially encapsulated in a plastic material 15. Plastic material 15 is a typical thermosetting resin that permanently hardens or solidifies when it is heated. Thus, hinge 14 may be partially surrounded and placed within material 15 by a conventional molding process.

Material 15 is one piece of continuous plastic that has a top section 18 and a bottom section 19.

Bottom section 19 has the same geometric shape as the portion of frame 11 that encircles cap 10 adjacent visor 12. Section 19 is connected to the inside surface of frame 11 by rivets 20. Top section 18 has basically the same geometric shape as the portion of cap cover 13 that runs adjacent to the portion of frame section 11 that is adjacent visor 12. A fabric tape 24 is folded in such a manner to allow a circular wire grommet 26 to move within the center portion of tape 24 when tape 24 is connected to section 18 by stiches 25. Grommmet 26 will be placed around the inside of cover 13.

Material 15 is shaped in such a manner that pivot pin 16 will not be contained within material 15 and an open space 22 will exist around portions of hinge 14 and pivot pin 16. Material 15 is tapered so that the portion of material 15 in the proximatery of hinge 14 i.e., area 23, will be thicker than the remaining portions of material 15. A lip 27 runs along part of the top edge of section 19 of material 15. Material 15 has the foregoing shape to facilitate the opening and closing of cap 10.

Hinge 14, pivot pin 16 and material 15 are shown in FIG. 2 when hinge 14 is in an open position. When hinge 14 is in an open postion, cap 10 will have the configuration shown in FIG. 1.

Cap 10 may be collapsed and hinge 14 closed when pressure is placed on the portion of cover 13 that contains section 18 of material 15. When cap 10 is collapsed, hinge 14 will be closed, peak 21 will move closer to visor 12 and cap 19 will have the configuration shown in FIG. 3.

FIG. 3 is a side view of cap 10 of FIG. 1 in a closed position showing hinge 14 folded about itself with material 15 surrounding portions of bottom section 19 and top section 18 near area 23 of hinge 14 with leaf spring 51 positioned above pin 16. In FIG. 3 the distance between peak 21 and visor 12 is less than the distance shown in FIG. 1. Visor 12, frame 11, leather band 36 and mounting buttons 17 will be in the same relative position as they were in FIG. 1.

The above specification describes a new and improved collapsible cap. It is realized that the above description may indicate to those skilled in the art additional ways in which the principles of this invention may be used without departing from its spirit. It is, therefore, intended that this invention be limited only by the scope of the appended claims.

What is claimed is:

1. A collapsible cap having a peak, frame, grommet, visor and cap cover, said cap comprising:
   a means for opening and closing said cap;
   a plastic material having a top and bottom portion, the top and bottom portion of said material encapsulates a portion of said means, the bottom portion of said material being connected to said frame and the top portion of said material being connected to a fabric that holds a portion of said grommet so that said cap may be opened when the top portion of said material is pushed up and said cap may be closed when the top portion of said material is pushed down.

2. The cap claimed in claim 1 wherein said means comprises: a hinge.

3. The cap claimed in claim 2 wherein said hinge has a pivot pin.

4. The cap claimed in claim 2 wherein said hinge further includes a leaf spring to supply resistance to the opening and closing of said hinge.

5. The cap claimed in claim 4 wherein said hinge further includes a cam.

6. The cap claimed in claim 1 wherein said plastic material is a thermosetting resin.

7. The cap claimed in claim 3 wherein said pivot pin and a portion of said hinge is not contained within said material.

8. The cap claimed in claim 1 wherein said plastic material is tapered.

* * * * *